US005350603A

United States Patent [19]

McFarland et al.

[11] Patent Number: 5,350,603

[45] Date of Patent: Sep. 27, 1994

[54] METHOD FOR PAINTING WINDOW LINEAL MEMBERS

[75] Inventors: Roger A. McFarland, Newark, Ohio; Gordon P. Armstrong, Sugarloaf, Pa.

[73] Assignee: Owens-Corning Fiberglas Technology Inc., Summit, Ill.

[21] Appl. No.: 884,357

[22] Filed: May 15, 1992

[51] Int. Cl.[5] ..... B05D 1/04

[52] U.S. Cl. ..... 427/470; 427/485; 427/290; 427/302; 427/316; 427/407.1; 427/419.1

[58] Field of Search ..... 427/485, 470, 302, 314, 427/316, 317, 290, 407.1, 419.1

[56] References Cited

U.S. PATENT DOCUMENTS

| | | | |
|---|---|---|---|
| 2,888,362 | 5/1959 | Starkey | 427/470 |
| 3,473,946 | 10/1969 | Roney | 427/470 |
| 3,915,809 | 10/1975 | Wheatley | 204/15 |
| 3,996,410 | 12/1976 | Gruetzman | 427/27 |
| 4,000,333 | 12/1976 | Cwayna et al. | 427/27 |
| 4,534,311 | 8/1985 | Reinlein et al. | 118/630 |
| 4,555,412 | 11/1985 | Günter et al. | 427/485 |
| 4,592,808 | 6/1986 | Doubt | 204/20 |
| 4,600,598 | 7/1986 | Nelson et al. | 427/470 |
| 4,686,108 | 8/1987 | Nason et al. | 427/470 |
| 4,732,777 | 3/1988 | Smythe | 427/27 |
| 4,752,513 | 6/1988 | Rau et al. | 428/91 |
| 4,816,331 | 3/1989 | Rau et al. | 428/294 |
| 4,892,750 | 1/1990 | Soshi et al. . | |
| 4,974,307 | 12/1990 | Uebayashi | 29/460 |
| 4,999,213 | 3/1991 | Meyer | 427/27 |
| 5,009,921 | 4/1991 | Traubel et al. | 427/31 |

*Primary Examiner*—Janyce Bell
*Attorney, Agent, or Firm*—Ted C. Gillespie

[57] ABSTRACT

A method for painting a plastic lineal member comprises heating the surface of the lineal member to a temperature greater than about 130° F., coating the lineal member with an aqueous solution, drying the lineal member, painting the lineal member, and curing the paint on the lineal member.

22 Claims, 1 Drawing Sheet

METHOD FOR PAINTING WINDOW LINEAL MEMBERS

TECHNICAL FIELD

This invention relates to painting elongated or lineal members, particularly such lineals members as are useful for making window sashes and window frames. In one its more specific aspects, this invention relates to the preparation of the surface of plastic lineal members in order to be in the best possible condition for receiving a coat of paint.

BACKGROUND ART

In the manufacture of lineal members, it is well known to use an electrostatic spray painting process to paint the members. The lineal members can be pultruded members or other types of elongated work pieces. For example, the lineal members could be wood molding strips which are sprayed with a varnish solution in a continuous process. Other lineal members have a plastic surface. Examples of these are pultruded members, extruded members, and other inline molded lineal members. An example of these is a lineal used in a fiberglass window frame, i.e., a lineal comprised of a glass wool core and a hard resinous outer coat.

Electrostatically painting these inherently nonconductive surfaces creates some problems. One of the solutions to enable an electrostatic painting process to be successful on a non-conductive product is to bury a conductive wire or web beneath the surface of the lineal member. The conductive material could then be grounded to provide an electrically attractive force for the charged paint particles in an electrostatic painting process. Another solution to the problem is to coat the lineal with a conductive solution, particularly a salt solution, which, when evaporated, will leave salt ions on the surface of the lineal. The salt ions remaining on the surface provide a sufficient conductive layer in order to act as a ground, thereby attracting the charged spray painted particles.

It has been found that when a plastic surface is to be spray painted, the use of a solvent as the carrier for the salts to be applied to the surface is very advantageous. The solvent evaporates quickly, and enables the conductive solution to disperse and spread uniformly on the surface of the lineal, thereby evenly distributing the salt ions on the lineal surface.

Unfortunately, the use of a solvent based conductive solution in preparation for an electrostatic painting process has some drawbacks. The solvents are potentially hazardous materials, and their use results in health and safety issues, and hazardous waste disposal penalties. Attempts to replace the solvent based conductive solutions with aqueous conductive solutions have not been successful. Aqueous solutions do not disperse as uniformly as solvent based solutions on the surface of plastic lineals. Also aqueous systems do not dry as readily as the solvent based conductive solutions.

It would be useful to have a non solvent-based carrier for the conductive solution, while still maintaining the solvent advantages of dispersibility on the lineal surface and quick evaporation of the carrier medium.

DISCLOSURE OF THE INVENTION

The present invention is directed to a method for applying an aqueous conductive solution which avoids the problem of the systems heretofore known for applying a conductive solution to a plastic lineal member. The method comprises heating the lineal member to a temperature of at least 130° F. prior to the application of the conductive solution. It has been found that when the lineal member is heated, preferably to at least 140° F., the aqueous solution readily disperses uniformly, and the heat of the lineal member causes the aqueous medium to evaporate from the surface rather quickly.

According to this invention, there is provided a method for painting a plastic lineal member comprising heating the surface of the lineal member to a temperature greater than about 130° F., coating the lineal member with an aqueous conductive solution, drying the lineal member, painting the lineal member, and curing the paint on the lineal member.

In a particular embodiment of the invention, the surface of the lineal member is heated to a temperature within the range of from about 135° F. to about 190° F. In a preferred embodiment of the invention, the surface of the lineal member is heated a temperature within the range of from about 140° F. to about 160° F.

In yet another embodiment of the invention, the surface of the lineal member is abraded prior to the coating step. The abrading step can be carried out by washing the surface of the lineal with water and aluminum oxide particles. Most preferably, the surface is washed with a mixture of water, aluminum oxide and glass beads.

The aqueous conductive solution is preferably a saline solution, and in a specific embodiment of the invention, the solution comprises calcium chloride, lithium chloride, and ethoxylated nonyl phenol.

In an alternate embodiment of the invention, the aqueous conductive solution itself can be heated, rather than having the lineal heated, in order to provide the beneficial effect of uniform dispersement of the conductive solution and rapid evaporation of the aqueous medium. Preferably, the conductive solution is heated to a temperature greater than about 140° F. It is believed that the heating of the lineal member, or the alternatively, the heating of the conductive solution itself, causes a change in the surface tension of the solution and makes it wet the surface more uniformly.

In a specific embodiment of the invention, the conductive solution is heated to a temperature within the range of from about 150° F. to about 200° F. In a preferred embodiment of the invention, the conductive solution is heated to a temperature within the range of from about 160° F. to about 190° F.

BEST MODE OF CARRYING OUT THE INVENTION

Figure 1:
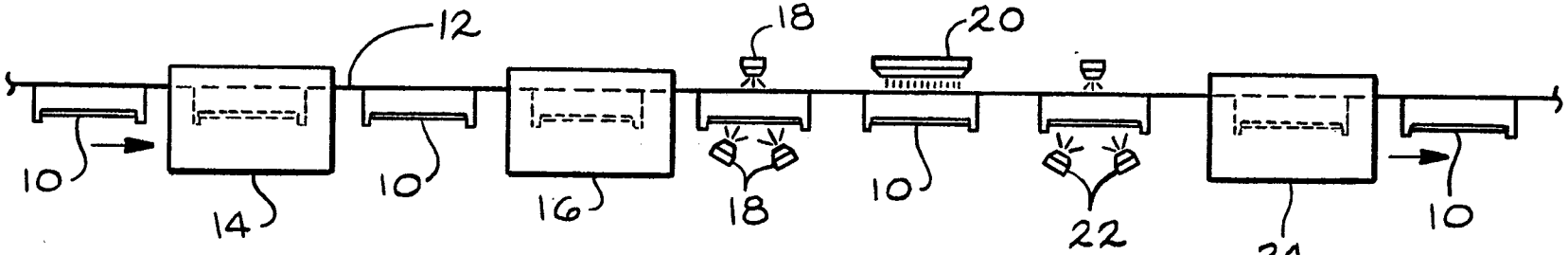
FIG. 1 is a schematic view in elevation of the apparatus for carrying out the method of painting lineal members according to the invention.

As shown in FIG. 1 the lineal members 10 are carried through the various process stations by conveyor 12. The conveyor can be any suitable means for conveying the lineal members through the process steps. For purposes of explaining the method of the invention, a process for painting a lineal comprised of a glass wool core and a hard resin outer coat of thermoset polyester will be described. It is to be understood that other lineal members having plastic outer surfaces can be painted according to the method of this invention.

One of the first process steps that the lineal is subjected to is the step of abrading the surface of the lineal. The lineal passes through washing booth 14 where an abrasive material is applied to the surface of the lineal member. The primary reason for this is to remove excessive styrene from the polyester resin surface coating of the lineal. Preferably, the abrasion step is accomplished by washing the surface of the lineal with water and aluminum oxide, such as 54–80 grit aluminum oxide from Exolon-ESK Co., Tonawanda, N.Y. Glass beads, such as size B glass beads from Potters Industries can be added to the water and aluminum oxide to limit the abrasive effects of the aluminum oxide (95% glass beads to 5% aluminum oxide by weight). The abrasive mixture can be approximately 2 lbs. of aluminum oxide per gallon of water, and the washing process can be operated at approximately 18 psi at speeds varying from 3 to 20 feet per minute to remove surface contaminants and slightly abrade the surface of the lineal to enhance the wettablity of the surface. A washing booth suitable for use with the invention is a model No. 035 by Kleiber and Schulz, Melville, N.Y.

It is believed that the abrasion process, which may be necessary to remove styrene and other impurities from the surface of the lineal member, opens up the surface portion of the lineal member, thereby enabling the lineal member to become somewhat penetrated by the aqueous conductive solution. Excessive absorption can result in trapped moisture beneath the paint of the finished lineal, thereby producing paint blisters, or other visual defects. The use of the preheating step prior to the application of the conductive solution minimizes the amount of penetration of the conductive solution into the surface of the lineal member.

In the next process step the lineal passes through a lineal heating station, such as prep oven 16. In the prep oven, the surface of the lineal member is heated to a temperature greater than about 130° F. This can be accomplished by any suitable means, such as by the circulation of hot air. Preferably, the temperature of the surface of the lineal member is raised to a temperature within the range from about 135° F. to about 190° F. Most preferably, the temperature is raised to within the range of from about 140° F. to about 160° F. Subsequent to the heating of the lineal, the conductive solution is sprayed from prep spray nozzles 18 onto the lineal. The nozzles can be any suitable nozzles for spraying an aqueous solution onto a lineal member. Preferably, the nozzles for the conductive solution are air atomized nozzles operating at 10 lbs. air pressure, although any suitable nozzles can be employed.

The conductive solution preferably is a saline solution. It has been found that a conductive solution comprising calcium chloride, lithium chloride and an ethoxylated nonyl phenol can be effective when used with the invention. A suitable conductive solution of this type is available as solution ECC519 from HSC Corporation, Detroit, Mich. Such a solution contains roughly 99% deionized water, and 1% of the ECC 519.

The fact that the lineal has been preheated to a temperature of at least 130° F. means that the aqueous solution will readily disperse on the surface of the lineal, and the aqueous medium will readily evaporate prior to the painting process.

After the conductive solution is applied, the lineals pass a drying station in which a heat lamp or convection hot air dryer, such as dryer 20, can be used to complete the drying before the painting process. Under certain conditions, the drying could be accomplished by contact with ambient air, either static or with forced convection.

The drying process has as its goal drying the product to a nearly completely dry condition prior to the painting. Once the lineal is completely dry, the salt ions will attract water from the air as long as there is sufficient relative humidity (at least 5%) in the air, thereby creating the necessary conductive ionized coating on the surface of the lineal.

The next step is application of paint, by any suitable means, such as paint nozzles 22, which are well known in the prior art. The paint can be any suitable paint for use on painting plastic lineal members in an electrostatic manner. Such paints are available from various manufacturers, such as from Sherman Williams, as will be well known to those skilled in the art. The paint is applied in an electrostatic paint process with electrically charged paint nozzles, and a grounded lineal. The residue from the conductive solution on the lineals ensures a widely dispersed electrically conductive surface for adequate grounding of the surface of the lineal, and the attraction of the paint particles to all areas of the lineal.

Subsequent to the painting process, the lineal is transported into the paint curing area, such as paint oven 24 where the paint is cured.

Figure 2:
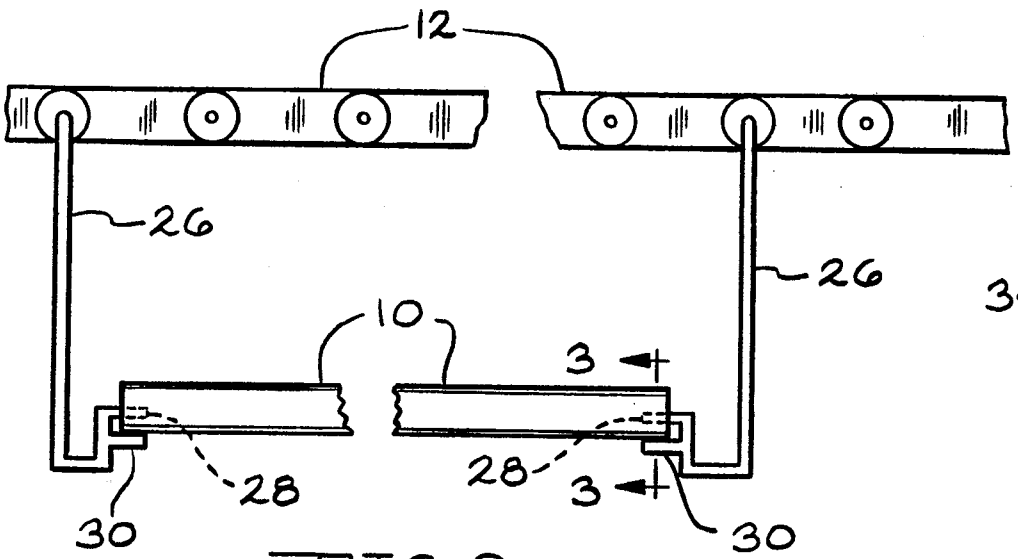
FIG. 2 is a schematic view in elevation of the conveyor and frame apparatus for conveying a lineal member through the various process stations of FIG. 1.

As shown in FIG. 2, the conveyor can be adapted with frame members, such as frames 26 which depend from the conveyor. The frames can be adapted with holding members, such as holding pins 28, for attaching to the lineal and supporting the lineal as it travels through the various stations of the process. The frame can also be adapted with a grounding member, such as grounding pins 30 for contact with the surface of the lineal member. In operation, the conveyor itself is grounded, and the ground travels through the frame and the grounding pin to the surface of the lineal. The charged paint particles are attracted to the ground on the surface of the lineal member. It is to be understood that multiple lineals can be mounted from each set of frames.

Figure 3:
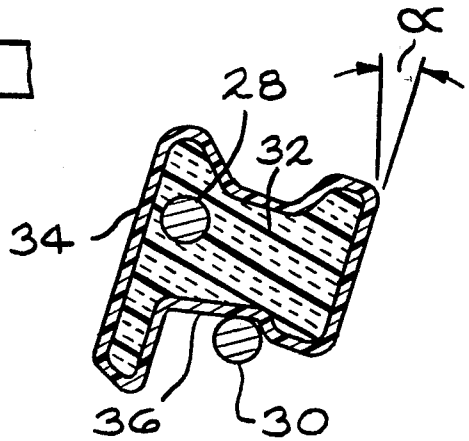
FIG. 3 is a sectional view in elevation of the lineal member and the grounding and holding pins, as viewed along line 3—3 of FIG. 2.

As shown in FIG. 3, the lineal can be comprised of a glass wool core 32 and hard resin outer coat 34. As shown, the holding pin can be positioned offset from the center of gravity of the lineal member, thereby biasing the lineal member into contact with the grounding member. The lineal member rotates as shown by the arrow, and is biased at an angle alpha toward the grounding pin to ensure good electrical contact between the grounding pin and the surface of the lineal.

As shown in FIGS. 2 and 3, the surface of the lineal is necessarily maintained in contact with the grounding pin during the painting process. This will create a small unpainted area on the lineal member. Preferably, this area is positioned on a non exposed or non critical surface, such as glazing surface 36, which is normally covered up by the glazing material when the lineal is used to manufacture a window sash, for example.

In an alternate embodiment of the invention, the aqueous solution itself is heated to a temperature greater than about 140° F. prior to the coating of the lineal member with the conductive solution. More preferably, the conductive solution is heated to a temperature within the range of from about 150° F. to about 200° F. Most preferably, the conductive solution is heated to a temperature of from about 160° F. to about 190° F. In this way, the lineal need not be heated, and yet the advantages of dispersibility and rapid evaporation of the aqueous medium can still be realized.

It will be evident from the foregoing that various modifications can be made to this invention. Such, however, are considered as being within the scope of the invention.

INDUSTRIAL APPLICABILITY

This invention will be found to be useful in the preparation and painting of lineals employed as window sash and frame members for windows.

We claim:

1. The method for electrostatically painting a plastic elongated substrate comprising heating the surface of the elongated substrate to a temperature greater than about 130° F., coating the elongated substrate with an aqueous conductive solution, drying the elongated substrate, electrostatically painting the elongated substrate, and curing the paint on the elongated substrate.

2. The method of claim 1 comprising heating the surface of the elongated substrate to a temperature within the range of from about 135° F. to about 190° F.

3. The method of claim 2 comprising heating the surface of the elongated substrate to a temperature within the range of from about 140° F. to about 160° F.

4. The method of claim 2 comprising abrading the surface of the elongated substrate prior to the coating step.

5. The method of claim 4 in which the abrading step is carried out by washing the surface of the elongated substrate with water and aluminum oxide.

6. The method of claim 5 in which the abrading step is carried out by washing the surface of the elongated substrate with a mixture of water, aluminum oxide and glass beads.

7. The method of claim 2 in which the conductive solution is an aqueous saline solution.

8. The method of claim 7 in which the conductive solution comprises calcium chloride, lithium chloride and an ethoxylated nonyl phenol.

9. The method of claim 2 in which the elongated substrate is mounted on a pair of holding members which are offset from the center of gravity of the elongated substrate, thereby biasing the elongated substrate into contact with a grounding member.

10. The method for electrostatically painting a plastic elongated substrate, the elongated substrate having a hard resinous outer surface and an inner core of insulating material, comprising heating the surface of the elongated substrate to a temperature within the range of from about 135° F. to about 190° F., coating the elongated substrate with an aqueous conductive solution containing at least one salt, drying the elongated substrate, electrostatically painting the elongated substrate, and curing the paint on the elongated substrate.

11. The method of claim 10 in which the surface of the plastic elongated substrate comprises a thermoset polyester.

12. The method for electrostatically painting a plastic elongated substrate comprising heating an aqueous conductive solution to a temperature greater than about 140° F., coating the elongated substrate with the conductive solution, drying the elongated substrate, electrostatically painting the elongated substrate, and curing the paint on the elongated substrate.

13. The method of claim 12 comprising heating the aqueous conductive solution to a temperature within the range of from about 150° F. to about 200° F.

14. The method of claim 13 comprising heating the aqueous conductive solution to a temperature within the range of from about 160° F. to about 190° F.

15. The method of claim 13 comprising abrading the surface of the elongated substrate prior to the coating step.

16. The method of claim 15 in which the abrading step is carried out by washing the surface of the elongated substrate with water and aluminum oxide.

17. The method of claim 16 in which the abrading step is carried out by washing the surface of the elongated substrate with a mixture of water, aluminum oxide and glass beads.

18. The method of claim 13 in which the conductive solution is an aqueous saline solution.

19. The method of claim 18 in which the conductive solution comprises calcium chloride, lithium chloride and an ethoxylated nonyl phenol.

20. The method of claim 13 in which the elongated substrate is mounted on a pair of holding members which are offset from the center of gravity of the elongated substrate, thereby biasing the elongated substrate into contact with a grounding member.

21. The method for electrostatically painting a plastic elongated substrate, the elongated substrate having a hard resinous outer surface and an inner core of insulating material, comprising heating an aqueous solution containing at least one salt to a temperature within the range of from about 180° F. to about 210° F., coating the elongated substrate with the aqueous solution, drying the elongated substrate, electrostatically painting the elongated substrate, an curing the paint on the elongated substrate.

22. The method of claim 21 in which the surface of the plastic elongated substrate comprises a thermoset polyester.

* * * * *